US009868282B2

(12) United States Patent
Ishikawa et al.

(10) Patent No.: US 9,868,282 B2
(45) Date of Patent: Jan. 16, 2018

(54) CONTROL APPARATUS AND CONTROL METHOD OF THE SAME

(71) Applicant: CANON KABUSHIKI KAISHA, Tokyo (JP)

(72) Inventors: Shinya Ishikawa, Kawasaki (JP); Yasufumi Ogasawara, Tachikawa (JP); Hisao Okita, Yokohama (JP); Takashi Sakai, Kawasaki (JP); Toru Oshika, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/153,004

(22) Filed: May 12, 2016

(65) Prior Publication Data

US 2016/0347059 A1 Dec. 1, 2016

(30) Foreign Application Priority Data

May 27, 2015 (JP) ..... 2015-107854

(51) Int. Cl.
*B41J 29/38* (2006.01)
*B41J 2/07* (2006.01)
*B41J 2/045* (2006.01)

(52) U.S. Cl.
CPC ..... *B41J 2/07* (2013.01); *B41J 2/0452* (2013.01); *B41J 2/0455* (2013.01); *B41J 2/0458* (2013.01); *B41J 2/04515* (2013.01); *B41J 2/04541* (2013.01); *B41J 2/04555* (2013.01)

(58) Field of Classification Search
CPC .. B41J 2/04541; B41J 2/04581; B41J 2/0455; B41J 2/04548; B41J 2/0458; B41J 2/0452; B41J 29/393; B41J 2/04515; B41J 2/04555; B41J 2/07
USPC ..... 347/5, 9, 10, 14, 19
See application file for complete search history.

(56) References Cited

U.S. PATENT DOCUMENTS

| | | | | |
|---|---|---|---|---|
| 8,143,898 | B1 * | 3/2012 | Markoff | A61B 6/583 324/522 |
| 8,148,945 | B2 | 4/2012 | Watanabe | |
| 2003/0122899 | A1 | 7/2003 | Kojoh et al. | |
| 2003/0160836 | A1 | 8/2003 | Fukano et al. | |
| 2012/0133693 | A1 | 5/2012 | Iijima | |

FOREIGN PATENT DOCUMENTS

| | | | |
|---|---|---|---|
| JP | 2010-030284 | A | 2/2010 |
| WO | 2010/052132 | A1 | 5/2010 |

OTHER PUBLICATIONS

European Search Report dated Oct. 13, 2016 in European Application No. 16000753.0.

* cited by examiner

*Primary Examiner* — Jannelle M Lebron
(74) *Attorney, Agent, or Firm* — Fitzpatrick, Cella, Harper & Scinto

(57) ABSTRACT

A control apparatus including a power supply unit configured to supply electric power, comprises: a capacitor connected to a power supply line extending from the power supply unit to a printhead; a discharge circuit configured to release charge stored in the capacitor; and a control unit configured to control a current value during a discharge operation by the discharge circuit, such that the current value increases as a voltage value of the capacitor decreases.

12 Claims, 8 Drawing Sheets

CONTROL APPARATUS AND CONTROL METHOD OF THE SAME

BACKGROUND OF THE INVENTION

Field of the Invention

The present invention relates to a control apparatus and a control method of the same.

Description of the Related Art

As the printing speed and printing resolution of an inkjet printing apparatus (to be referred to as a printing apparatus hereinafter) improve in recent years, the number of nozzles for discharging ink is increasing. When forming an image by using the printing apparatus like this, the power consumption changes in accordance with the density of an image. For example, when forming a high-density image by discharging a large amount of ink onto the paper surface by using a thermal method, a large number of heaters arranged near the ink discharge ports of nozzles are instantaneously turned on, so a large current flows within a short time period.

When designing a power supply which supplies a large instantaneous current, the impedance of the power supply must generally be decreased. As one means for a printer, a method of connecting an electrolyte capacitor to a power supply line near a printhead is known. Since charge stored in the electrolyte capacitor is supplied as instantaneous electric power, it is possible to prevent a heat driving voltage drop and implement stable ink discharge even in a situation in which a large current instantaneously flows. Recently, the capacitance of this electrolyte capacitor must be increased for a head in which the number of nozzles has increased. In addition, the supply power of the power supply itself must be increased in accordance with the increase in number of nozzles.

On the other hand, to shorten the processing time of the printing apparatus, it is necessary to shorten the time of each of charging and discharge of a large-capacitance electrolyte capacitor, and currents flowing through a charging circuit and discharge circuit tend to increase accordingly. However, this increase in current increases the generation of heat of the charging circuit and discharge circuit. For example, Japanese Patent Laid-Open No. 2010-30284 has disclosed a method of restricting currents by performing charging and discharge via a resistor.

Unfortunately, the cost of the charging circuit and discharge circuit disclosed in Japanese Patent Laid-Open No. 2010-30284 can be reduced because current restriction using the resistor need only be performed, but this arrangement does not shorten the charging time and discharge time.

SUMMARY OF THE INVENTION

The present invention has been made to solve the above problem, and shortens the discharge time while suppressing the generation of heat of a discharge circuit, by using a large-capacitance electrolyte capacitor as the power supply of a printhead.

According to one aspect of the present invention, there is provided a control apparatus including a power supply unit configured to supply electric power, comprising: a capacitor connected to a power supply line extending from the power supply unit to a printhead; a discharge circuit configured to release charge stored in the capacitor; and a control unit configured to control a current value during a discharge operation by the discharge circuit, such that the current value increases as a voltage value of the capacitor decreases.

According to another aspect of the present invention, there is provided a control method of a control apparatus which comprises: a power supply unit configured to supply electric power; a capacitor connected to a power supply line extending from the power supply unit to a printhead; and a discharge circuit configured to release charge stored in the capacitor, wherein a current value is controlled during a discharge operation by the discharge circuit, such that the current value increases as a voltage value of the capacitor decreases.

The present invention can shorten the discharge time of an electrolyte capacitor to be used as the power supply of a printhead. In addition, the present invention can suppress the generation of heat of a discharge circuit when short to supply occurs.

Further features of the present invention will become apparent from the following description of exemplary embodiments (with reference to the attached drawings).

DESCRIPTION OF THE EMBODIMENTS

An embodiment of the present invention will be explained below with reference to the accompanying drawings. Note that a printing apparatus to be disclosed below can be a printer having a single function, and can also be a multi-function apparatus having a plurality of functions.

First Embodiment

[Circuit Configuration]

Figure 1:
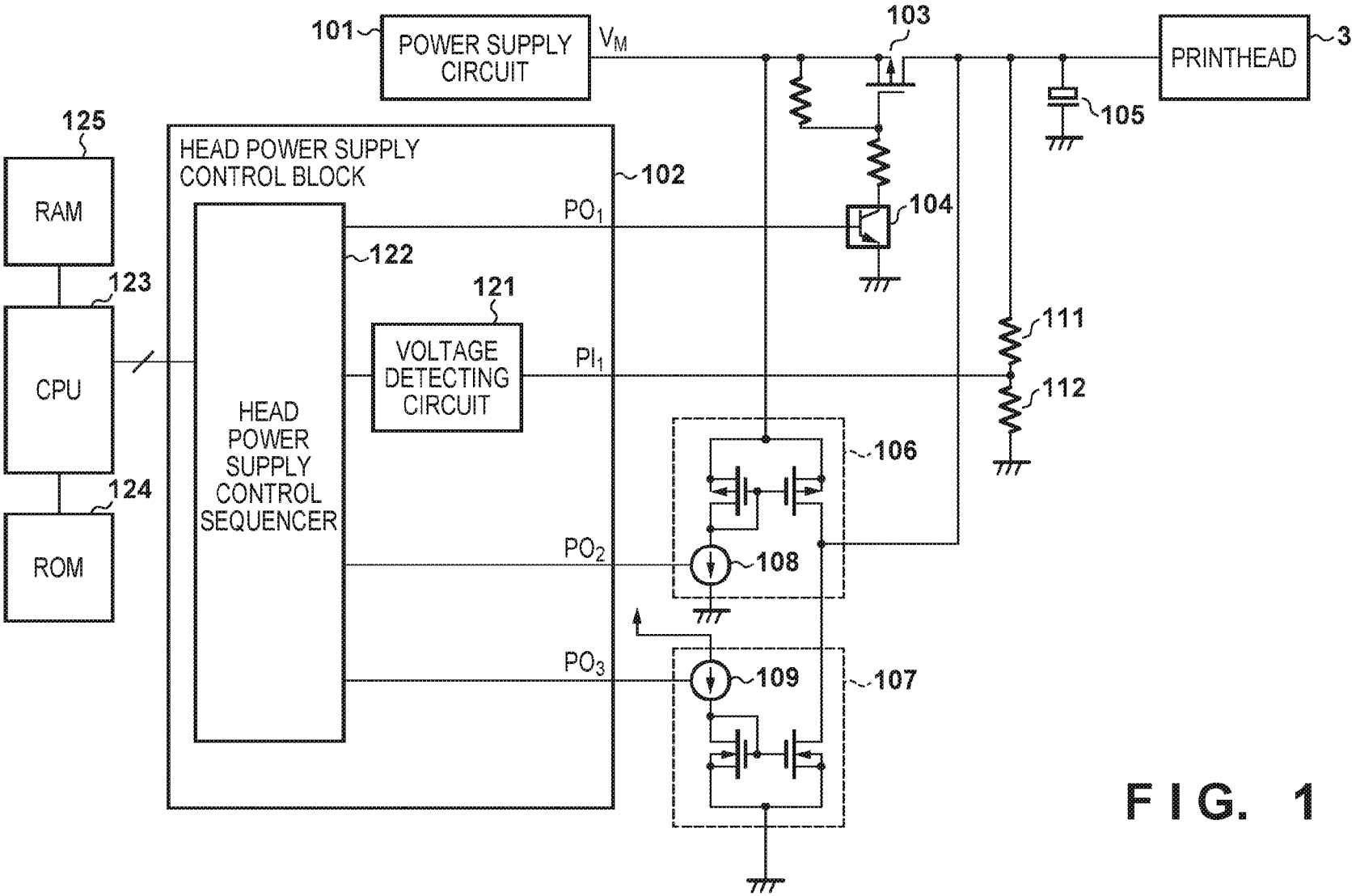
FIG. 1 is a view showing a configuration example of a control circuit of a driving power supply of a printhead according to an embodiment.

FIG. 1 is a block diagram showing an example of the main configuration of a control circuit of a printing apparatus. Referring to FIG. 1, a power supply circuit 101 operates as a power supply unit, and provides a DC voltage for driving a printhead 3 from an AC power supply. In the power supply circuit 101, $V_M$ denotes the output DC voltage to be used in a head power supply which supplies power to the printhead 3.

A CPU 123 controls the whole printing apparatus. A ROM 124 is a nonvolatile storage area, and stores programs and setting parameters for controlling the whole printing apparatus. A RAM 125 is a volatile storage area, and is used as a work area for converting an externally received print job into printing data, and expanding a program.

A head power supply control block 102 is a portion for controlling the head power supply, and includes a voltage detecting circuit 121 and head power supply control sequencer 122. The head power supply control block 102 also includes output terminals $PO_1$, $PO_2$, and $PO_3$ and an input terminal $PI_1$. The voltage detecting circuit 121 is a circuit for detecting the power supply voltage to be supplied to the printhead 3. The voltage detecting circuit 121 can be an AD converter, and can also be a circuit given a plurality of thresholds by arranging a plurality of comparators. In this embodiment, the voltage of the head power supply is divided by resistors 111 and 112, and input from the input terminal $PI_1$ to the voltage detecting circuit 121.

The CPU 123 and head power supply control circuit 102 can be mounted as one integrated circuit on LSI (Large-Scale Integration), and can also be mounted on different LSIs.

The printing apparatus further includes the printhead 3, an FET 103, a transistor 104, and an electrolyte capacitor 105. The FET 103 is an FET (Field Effect Transistor) to be turned on when the printhead 3 requires a high electric power in order to perform a printing operation. In this embodiment, the gate is opened and closed by turning on and off the transistor 104 by using a PMOS. As shown in FIG. 1, the FET 103 is arranged on a power supply line between the power supply circuit 101 and printhead 3. The transistor 104 is connected to the output terminal $PO_1$ of the head power supply control block 102, and turned on and off by High/Low of a signal from $PO_1$. The electrolyte capacitor 105 supplies power to the printhead 3.

A charging circuit 106 and discharge circuit 107 indicated by the dotted lines in FIG. 1 are circuits to be used when charging and discharging the electrolyte capacitor 105. The charging circuit 106 is a constant-current circuit having a current-mirror configuration, and a current source 108 generates a reference current. The current source 108 is controlled by a signal output from the output terminal $PO_2$ of the head power supply control block 102, and a plurality of stages of current values can be switched in accordance with the signal.

The discharge circuit 107 is a circuit for releasing charge stored in the electrolyte capacitor 105. Like the charging circuit 106, the discharge circuit 107 has a current-mirror configuration. In the discharge circuit 107, a constant-current source 109 generates a reference current. Also, the constant-current source 109 is controlled by a signal output from the output terminal $PO_3$ of the head power supply control block 102, and a plurality of stages of current values can be switched like the current source 108.

As described previously, this embodiment includes the large-capacitance electrolyte capacitor as the power supply of the printhead, and yet shortens the charge/discharge time of this electrolyte capacitor. Furthermore, the generation of heat of the discharge circuit may also be suppressed when the discharge circuit is shorted to supply after the discharge of the electrolyte capacitor is complete. Note that "short to supply" indicates "short to the power supply".

[Operation Procedure]

Figure 2A:
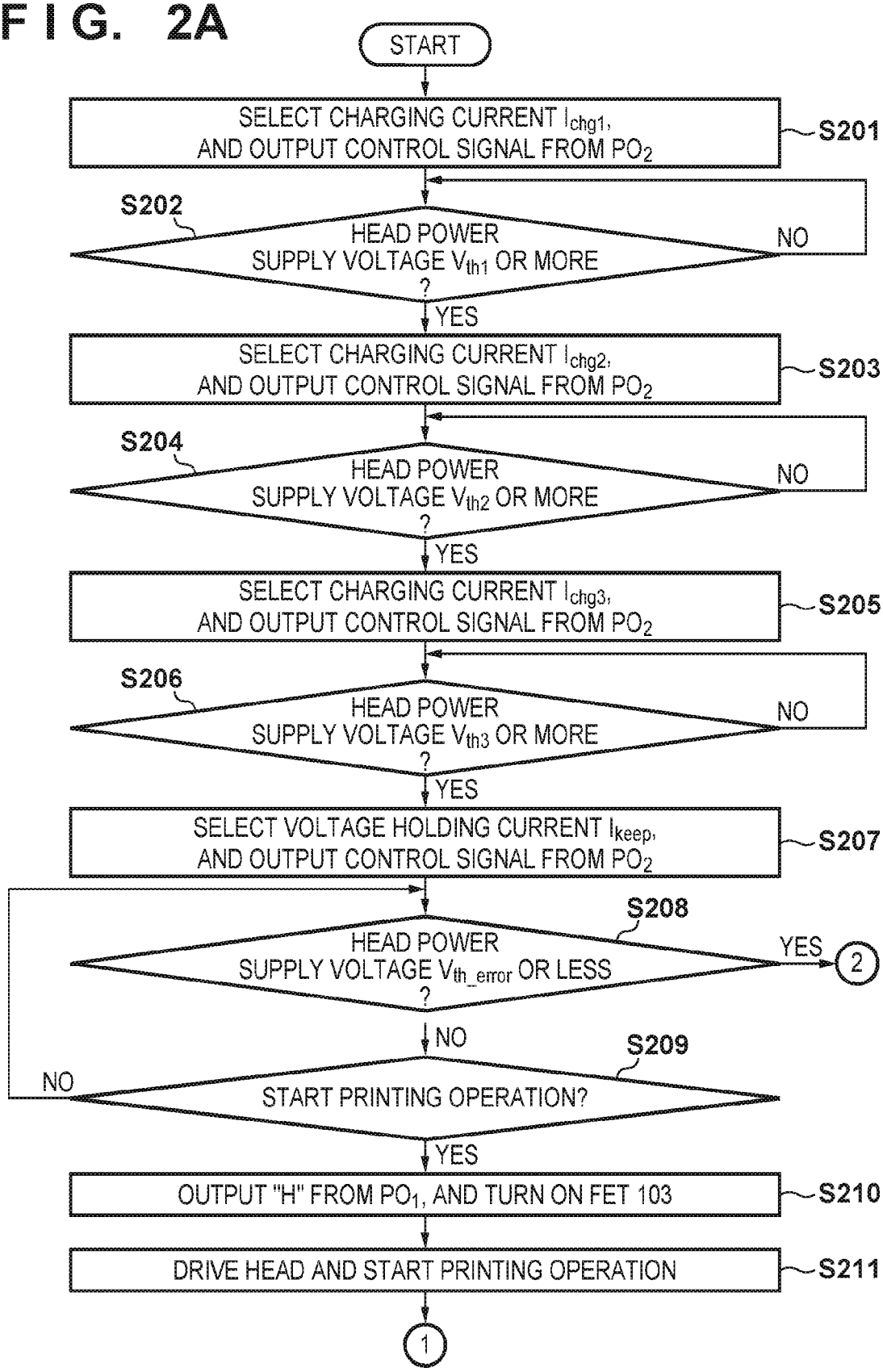
FIGS. 2A and 2B are flowcharts showing an operation of supplying electric power to the printhead according to the embodiment.
Figure 2B:
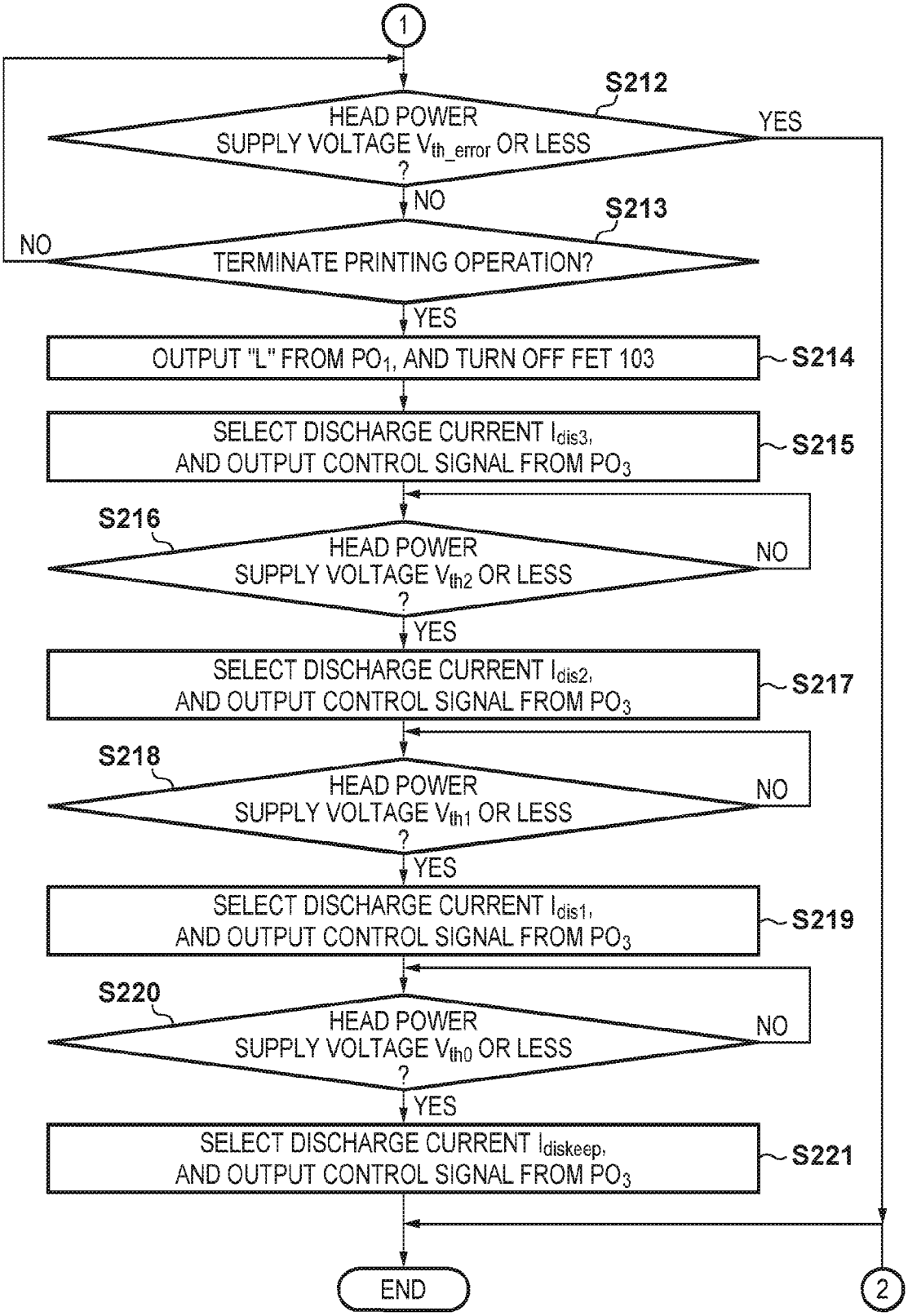
Figures 3A, 3B, 3C:
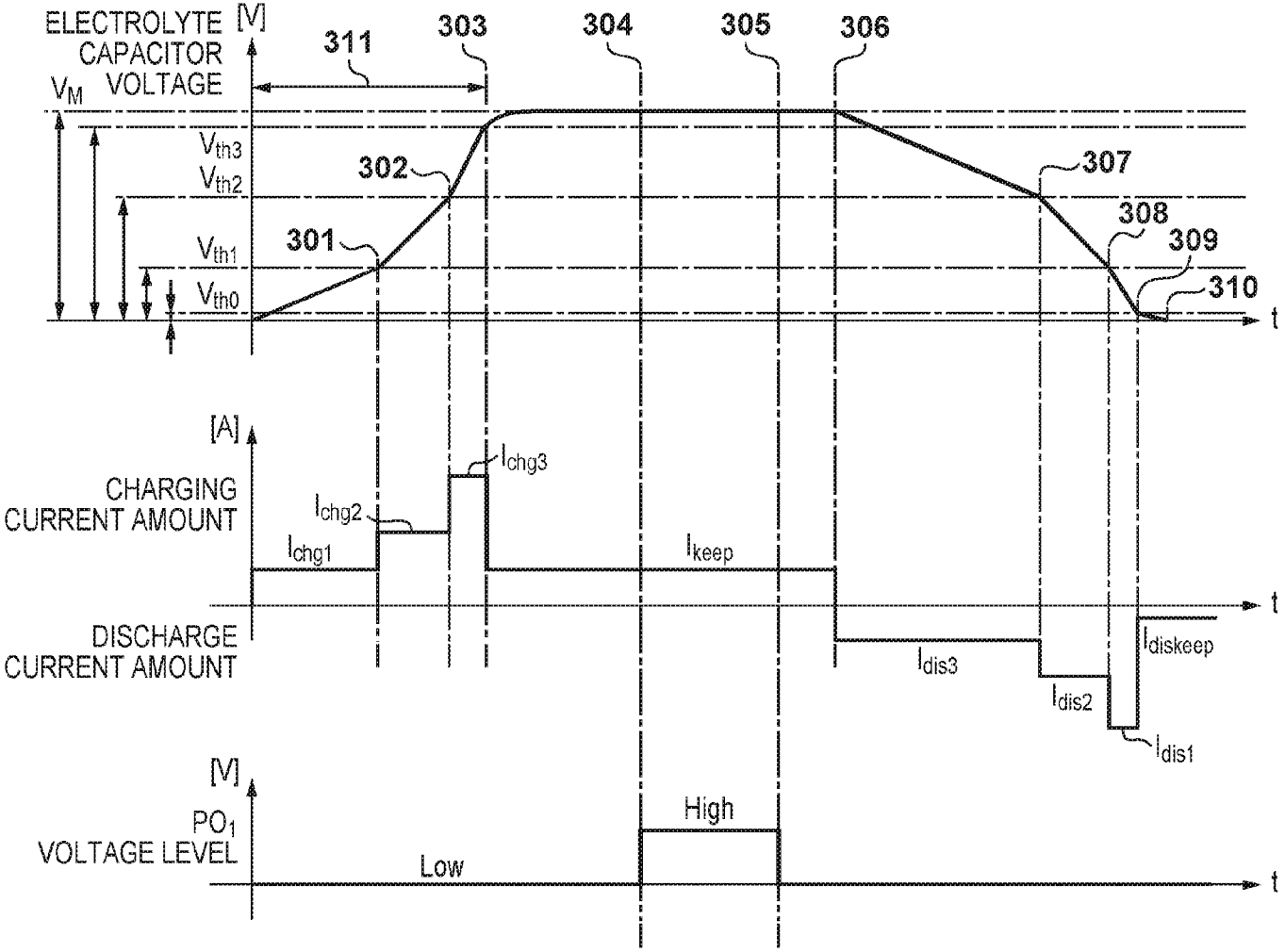
FIGS. 3A, 3B, and 3C are timing charts pertaining to an electrolyte capacitor according to the embodiment.

A head power supply control sequence will be explained with reference to FIGS. 1 to 3C. FIGS. 2A and 2B show a procedure when the printing apparatus receives a printing command and the printhead 3 is powered on and performs a printing operation from a state in which no power supply voltage is applied to the printhead 3. FIGS. 3A to 3C are timing charts associated with the control shown in FIGS. 2A and 2B. In FIG. 3A, the ordinate indicates the voltage [V] of the electrolyte capacitor, and the abscissa indicates the passage of time. In FIG. 3B, the ordinate indicates the current value [A], and the abscissa indicates the passage of time. Note that on the ordinate in FIG. 3B, a portion above the origin is a charging current, and a portion below the origin is a discharge current. In FIG. 3C, the ordinate indicates the voltage level of the output terminal $PO_1$ of the head power supply control block 102, and the abscissa indicates the passage of time. Note that the timings of the time passage shown in FIGS. 3A to 3C correspond to each other.

This control sequence is roughly divided into steps S201 to S207 as a charge period (charging operation) of the electrolyte capacitor 105, steps S208 to S214 as a printing operation period (printing operation), and steps S215 to S221 as a discharge period (discharge operation) of the electrolyte capacitor 105.

Also, $I_{chg1}$, $I_{chg2}$, and $I_{chg3}$ shown in FIGS. 2A and 2B indicate the values of the charging current, and are switched in accordance with the voltage state of the electrolyte capacitor 105, and with thresholds $V_{th1}$ and $V_{th2}$ with respect to the voltage. As described above, the head power supply control block 102 controls switching of the charging currents. The relationship between the values of the charging current is $I_{chg1}<I_{chg2}<I_{chg3}$. The relationship between the thresholds is $V_{th1}<V_{th2}$. Note that $V_{th3}$ is a voltage higher than $V_{th2}$ and lower than $V_M$, and is a threshold for detecting that charging of the electrolyte capacitor 105 is complete.

Similarly, $I_{dis1}$, $I_{dis2}$, and $I_{dis3}$ shown in FIGS. 2A and 2B indicate the values of the discharge current, and are switched in accordance with the voltage state of the electrolyte capacitor 105, and with the thresholds $V_{th1}$ and $V_{th2}$ with respect to the voltage. The head power supply control block 102 controls switching of the discharge currents. Note that the relationship between the absolute values of the discharge current is $I_{dis3}<I_{dis2}<I_{dis1}$. For example, $I_{dis3}$ is "−1 A", $I_{dis2}$ is "−2 A", and $I_{dis1}$ is "−3 A". The discharge current increases as the voltage value of the electrolyte capacitor 105 decreases.

Switching of the current values in the charge period is performed in order to complete charging as rapidly as possible while satisfying the thermal restriction of a charging FET. That is, setting must be performed such that heat calculated by the product of the drain-source potential difference of the charging FET of the charging circuit 106 and a flowing current satisfies the allowable loss of the charging FET. For example, when the potential difference is $(V_M-V_{th1})$ and the current is $I_{chg1}$, the amount of generated heat is represented by $(V_M-V_{th1})\times I_{chg1}$. In this embodiment, setting is performed so that the amounts $(V_M-V_{th1})\times I_{chg1}$, $(V_M-V_{th2})\times I_{chg2}$, and $(V_M-V_{th3})\times I_{chg3}$ of generated heat are respectively equal to or smaller than predetermined allowable losses.

Similarly, switching of the current values in the discharge period is performed in order to complete discharge as rapidly as possible while satisfying the thermal restriction of a discharge FET. That is, setting must be performed such that heat calculated by the product of the drain-source potential difference of the discharge FET of the discharge circuit 107 and a flowing current satisfies the allowable loss of the discharge FET. For example, when the potential difference is $(V_M-V_{th3})$ and the current is $I_{chg3}$, the amount of generated heat is represented by $(V_M-V_{th3})\times I_{chg3}$. In this embodiment, setting is performed so that the amounts $(V_M-V_{th3})\times I_{chg3}$, $(V_M-V_{th2})\times I_{chg2}$, and $(V_M-V_{th1})\times I_{chg1}$ of generated heat are respectively equal to or smaller than predetermined allowable losses. In this embodiment, setting is performed so that the amounts of generated heat are respectively equal to or a smaller than predetermined allowable losses. Note that switching of the current values is indicated by three stages in this embodiment, but this is merely an example, so the number of stages can increase or decrease. For example, control can be performed by two stages or four or more stages in accordance with the values of the allowable losses of the charging FET and discharge FET. Therefore, the current source 108 is controlled by signals from the output terminals $PO_2$ and $PO_3$ of the head power supply control block 102 in accordance with the switching timing.

FIG. 3A shows that the voltage rise curve becomes steep as the voltage rises during a charge period 311. This is so because, as shown in FIG. 3B, the charging current value is switched from $I_{chg1}$ to $I_{chg2}$ at a timing 301 at which the voltage of the electrolyte capacitor exceeds the threshold $V_{th1}$. The charging current value is further switched from $I_{chg2}$ to $I_{chg2}$ at a timing 302 at which the voltage of the electrolyte capacitor exceeds the threshold $V_{th2}$. Thus, the potential difference between the power supply circuit 101 and electrolyte capacitor 105 is large from the timing at which the voltage starts rising to the timing 301 shown in FIG. 3A. If a large current flows in this situation, the amount of generated heat of the charging circuit 106 increases. Accordingly, the generation of heat of the charging circuit 106 can be suppressed by selecting $I_{chg1}$ shown in FIG. 3B as the current value of the charging circuit 106 during the period from the start of voltage rise to the timing 301 shown in FIG. 3A.

On the other hand, the potential difference between the power supply circuit 101 and electrolyte capacitor 105 decreases with the passage of time. That is, the generation of heat can be suppressed even when a current larger than $I_{chg1}$ flows. Therefore, the charging circuit 106 supplies $I_{chg2}$ larger than $I_{chg1}$ in the period between the timings 301 and 302 during which the potential difference decreases. Consequently, the charging time can be shortened while the generation of heat of the charging circuit 106 is suppressed. Likewise, since the potential difference further decreases from the timing 302 to a timing 303, the charging circuit 106 can supply $I_{chg3}$. This can further shorten the charging time. That is, a charging current value which shortens the charging time is selected.

When the process is started in FIGS. 2A and 2B, in step S201, the head power supply control block 102 selects $I_{chg1}$ as the charging current value, and outputs the control signal from $PO_2$ to the charging circuit 106. Accordingly, the charging circuit 106 outputs the charging current value $I_{chg1}$.

In step S202, the head power supply control block 102 determines whether the charging voltage of the electrolyte capacitor 105 exceeds $V_{th1}$. The value ($I_{chg1}$) of the charging current is maintained until $V_{th1}$ is exceeded. If the charging voltage of the electrolyte capacitor 105 exceeds $V_{th1}$ (YES in step S202), the process advances to step S203, and the head power supply control block 102 outputs a control signal from $PO_2$ to the charging circuit 106 so as to switch the charging current value from $I_{chg1}$ to $I_{chg2}$. This corresponds to the timing 301 in FIG. 3B.

Analogously, in steps S203 to S205, the head power supply control block 102 performs control so as to switch the charging current value from $I_{chg2}$ to $I_{chg3}$. This corresponds to the timing 302 in FIG. 3B.

In step S206, the head power supply control block 102 determines whether the charging voltage of the electrolyte capacitor 105 has reached $V_{th3}$. If the charging voltage has reached $V_{th3}$ (YES in step S206), the head power supply control block 102 switches the charging current value to $I_{keep}$ in step S207. $I_{keep}$ is a current value for holding the charging voltage and detecting an increase in head leakage. This switching timing corresponds to the timing 303 in FIG. 3B.

In step S208, the head power supply control block 102 determines whether the charging voltage of the electrolyte capacitor 105 is $V_{th_error}$ or less. More specifically, the CPU 123 is monitoring the charging voltage of the electrolyte capacitor 105. This monitoring by the CPU 123 will be described later. If the charging voltage of the electrolyte capacitor 105 is $V_{th_error}$ or less (YES in step S208), the head power supply control block 102 determines that the process is not executable, and terminates the process as an error.

If the charging voltage of the electrolyte capacitor 105 is higher than $V_{th_error}$ (NO in step S208), the head power supply control block 102 determines whether to start a printing operation in step S209. More specifically, when the preparation of print data is complete and a printing operation start instruction is accepted from the CPU 123, the head power supply control block 102 determines to start the printing operation. If the head power supply control block 102 determines not to start the printing operation (NO in step S209), the process returns to step S208 and waits.

If the printing operation is to be started (YES in step S209), the head power supply control block 102 changes the output of $PO_1$ to "High" in step S210. This is equivalent to turning on the FET 103 in FIG. 1, and corresponds to a timing 304 in FIG. 3C. Note that by turning on the FET 103, the power supply circuit 101 supplies power necessary for printing to the printhead 3. On the other hand, while the FET 103 is turned on and the power supply circuit 101 is supplying power to the printhead, the head power supply control block 102 keeps supplying $I_{keep}$ as the supply current to the electrolyte capacitor. This corresponds to a period from the timing 304 to a timing 305 in FIG. 3C.

In step S211, the head is driven to start the printing operation.

In step S212, the head power supply control block 102 determines whether the charging voltage of the electrolyte capacitor 105 is $V_{th_error}$ or less. More specifically, this monitoring is performed by the CPU 123 as in step S208, and continued until the printing operation is complete. If the charging voltage of the electrolyte capacitor 105 is $V_{th_error}$ or less (YES in step S212), the head power supply control block 102 determines that the printing operation is not continuable, and terminates the process as an error.

If the printing operation is complete (YES in step S213) after that, the head power supply control block 102 changes the output of $PO_1$ to "Low" in step S214. This is equivalent to turning off the FET 103 in FIG. 1, and corresponds to the timing 305 in FIG. 3C. Note that at this point of time, as shown in FIG. 3B, $I_{keep}$ is maintained as the supply current to the printhead 3. In this step, it is also possible to determine whether to further perform a succeeding printing operation, and return to step S210 and repeat the process if it is necessary to further execute a printing operation.

After the printing operation is complete, the head power supply control block 102 executes control of discharging the electrolyte capacitor 105 as the head power supply in steps S215 to S221. That is, the head power supply control block 102 performs discharge by using the discharge circuit 107 while performing control so as to reduce the current value as the voltage of the electrolyte capacitor 105 decreases. In this discharge, the thermal restriction of the FET in the discharge circuit 107 must be satisfied as in charging. The source-drain potential difference of the FET in the discharge circuit 107 is the difference between GND and the head power supply voltage, so the potential difference increases as the potential of the head power supply rises.

In step S215, the head power supply control block 102 selects $I_{dis2}$ as the discharge current value, and outputs the control signal from $PO_3$ to the discharge circuit 107. Accordingly, the discharge circuit 107 sets $I_{dis2}$ as the discharge current value, and performs discharge. This corresponds to a timing 306 in FIG. 3B.

In step S216, the head power supply control block 102 determines whether the charging voltage of the electrolyte capacitor 105 is $V_{th2}$ or less, and maintains $I_{dis3}$ until the charging voltage becomes $V_{th2}$ or less. If the charging voltage of the electrolyte capacitor 105 is $V_{th2}$ or less (YES in step S216), the head power supply control block 102 outputs a control signal from $PO_3$ to the discharge circuit 107 so as to switch the discharge current value to $I_{dis2}$ (step S217). This corresponds to a timing 307 in FIG. 3B.

After that, the value of the discharge current is similarly controlled by processes in steps S218 and S219.

By thus executing the processes in steps S215 to S219, it is possible to shorten the discharge time of the electrolyte capacitor 105 while suppressing the generation of heat of the discharge circuit 107. This will be explained in detail below. The potential difference between the electrolyte capacitor 105 and GND is large from the timing 306 to the timing 307. If a large current flows in this situation, the amount of generated heat of the discharge circuit 107 increases. Between the timings 306 and 307, therefore, the generation of heat of the discharge circuit 107 can be suppressed by selecting $I_{dis3}$ in FIG. 3B as the current value of the discharge circuit 107. On the other hand, the potential difference between the electrolyte capacitor 105 and GND decreases with the passage of time. That is, the generation of heat can be suppressed even if a current larger than $I_{dis3}$ is discharged. Accordingly, in a period from the timing 307 to a timing 308 during which the potential difference decreases, the discharge circuit 107 selects $I_{dis2}$ by which the amount of current to be discharged is larger than that of $I_{dis3}$. As a consequence, the discharge time can be shortened while suppressing the generation of heat of the discharge circuit 107. Analogously, the potential difference further decreases in a period from the timing 308 to a timing 309, so the discharge circuit 107 selects $I_{dis1}$. This can further shorten the discharge time. That is, a discharge current value which shortens the discharge time is selected.

In step S220, the head power supply control block 102 determines whether the charging voltage of the electrolyte capacitor 105 is $V_{th0}$ or less, and maintains $I_{dis1}$ until the charging voltage of the electrolyte capacitor 105 is $V_{th0}$ or less. If the charging voltage of the electrolyte capacitor 105 is $V_{th0}$ or less (YES in step S220), the process advances to step S221, and the head power supply control block 102 outputs a control signal from $PO_3$ to the discharge circuit 107 so as to switch the discharge current value to $I_{diskeep}$. This corresponds to the timing 309 in FIG. 3B. $I_{diskeep}$ is a current restricting value. Therefore, when the head power supply completes discharge and there is no potential difference before and after the discharge circuit 107, no current flows. Thus, the control process is complete.

[Operation of CPU]

The operation of the CPU 123 according to this embodiment will be explained below. The CPU 123 manages the overall control of a printing operation and manages a normal operation of the head power supply. Details will be described below.

(1) When receiving an external print command, the CPU 123 starts preparing print data, and outputs a command for turning on the head power supply to the head power supply control block 102. The head power supply control block 102 receives this command and starts the procedure shown in FIGS. 2A and 2B.

(2) While preparing print data, the CPU 123 monitors the state of the head power supply control sequencer 122. Details of this state will be described later with reference to FIGS. 4A to 4C. If the CPU 123 detects that the state is a charging state or holding state, the CPU 123 periodically monitors the output value of the voltage detecting circuit 121, or a value obtained by directly inputting the divided voltage between the resistors 111 and 112 and converting the input voltage by AD conversion. If this value is a value equivalent to "a state in which the charging voltage of the electrolyte capacitor 105 is $V_{th_error}$ or less", the CPU 123 determines that the state is an abnormal state, and performs error processing. Note that instead of monitoring the state of the head power supply control sequencer 122, it is also possible to compare the voltage of the head power supply with a threshold, based on the output value of the voltage detecting circuit 121, or the value obtained by directly inputting the divided voltage between the resistors 111 and 112 and converting the input voltage by AD conversion.

(3) When print data is prepared in a state which is not an error state, the CPU 123 determines that printing can be started, and outputs a printing operation start command to the head power supply control block 102. The head power supply control block 102 receives this command and performs the process in step S210. After that, the CPU 123 transmits the print data to the printhead 3, and causes the printhead 3 to perform the printing operation.

(4) When the printing operation is complete, the CPU 123 outputs a printing operation termination command to the head power supply control block 102. The head power supply control block 102 receives this command and performs the process in step S214.

(5) If there is succeeding print job data after the operation of the print job is once completed (YES in step S213) as described above, the processes of (2) and (3) are repeated. If there is no print job data, the CPU 123 outputs a head power supply OFF command to the head power supply control block 102. The head power supply control block 102 receives this command and performs the process in step S214.

[Head Power Supply Control Block]

Figure 4A:
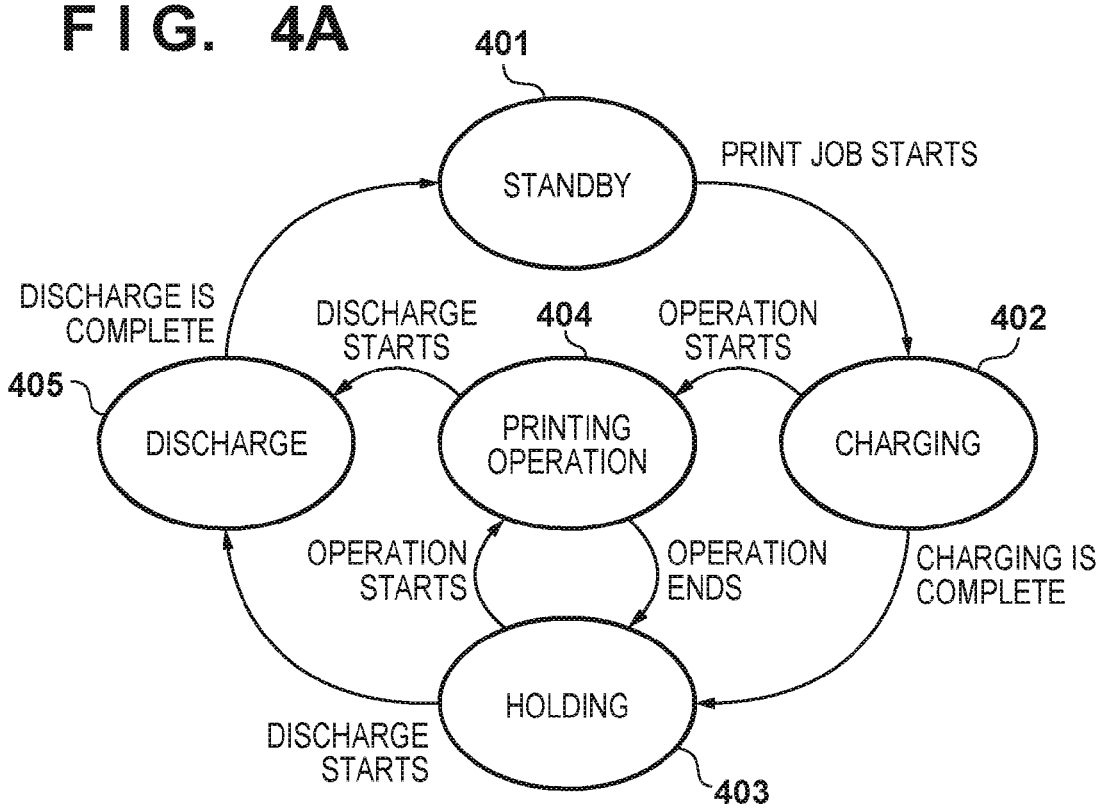
FIGS. 4A, 4B, and 4C are state transition diagrams when controlling the power supply of the printhead according to the embodiment.
Figure 4B:
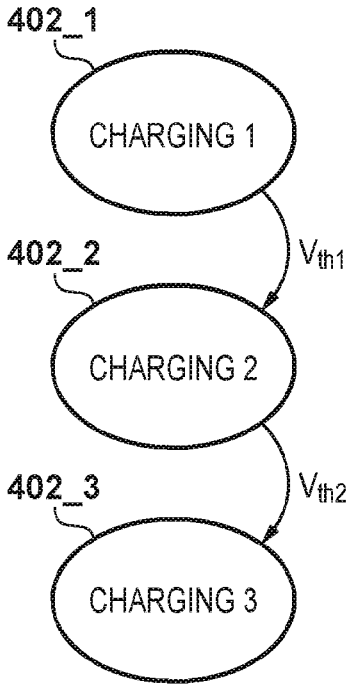
Figure 4C:
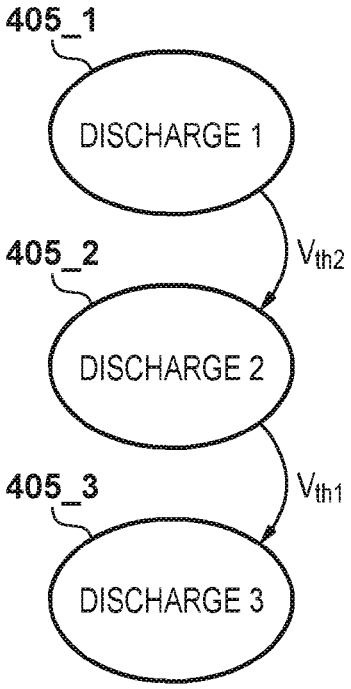

The head power supply control block 102 will be explained below. FIGS. 4A to 4C are views for explaining the state transition in the head power supply control sequencer 122. Referring to FIG. 4A, a state in which the head power supply is OFF is standby 401. When a print job is input, the state changes to charging 402 in order to turn on the head power supply. As shown in FIG. 4B, switching of current values in charging 402 is that charging 1 of 402_1 changes to charging 2 when the voltage of the electrolyte capacitor 105 exceeds $V_{th1}$. In this state, the charging current value is switched from $I_{chg1}$ to $I_{chg2}$ as described previously. Analogously, when charging 2 of 402_2 changes to charging 3 of 402_3, the charging current value is switched from $I_{chg2}$ to $I_{chg3}$. When charging is complete, the state changes to holding 403 in FIG. 4A. Accordingly, the charging current value is switched to $I_{keep}$. Note that if a printing operation is urgent, it is also possible to directly change to the state of printing operation 404.

The state changes to printing operation 404 during the printing operation, and changes between holding 403 and printing operation 404 until the print job is complete. A head power supply voltage monitor (not shown) easily detects abnormality particularly in the state of holding 403. However, it is also possible to detect abnormality in the state of printing operation 404, and immediately change to the state of discharge 405.

In the state of discharge 405, as shown in FIG. 4C, the state sequentially changes to discharge 1 of 405_1, discharge 2 of 405_2, and discharge 3 of 405_3, as the discharge current value is switched to $I_{dis3}$, $I_{dis2}$, and $I_{dis1}$, respectively. When discharge is complete, the discharge current value is switched to $I_{diskeep}$, and the state changes to standby 401. Note that in order to decrease the current value after discharge is complete, it is also possible to switch the state to a high-impedance state, instead of switching the discharge current value to $I_{diskeep}$.

$I_{diskeep}$ shown in step S221 of FIG. 2B and used as the discharge current value after the timing 309 in FIG. 3B will be explained below. $I_{diskeep}$ must be a current value which is small to such an extent that the FET of the discharge circuit 107 causes no thermal destruction when the charging voltage of the electrolyte capacitor 105 shorts to $V_M$ or a maximum voltage power supply in the apparatus and the source-drain potential difference of the FET of the discharge circuit 107 increases.

Figures 5A, 5B, 5C:
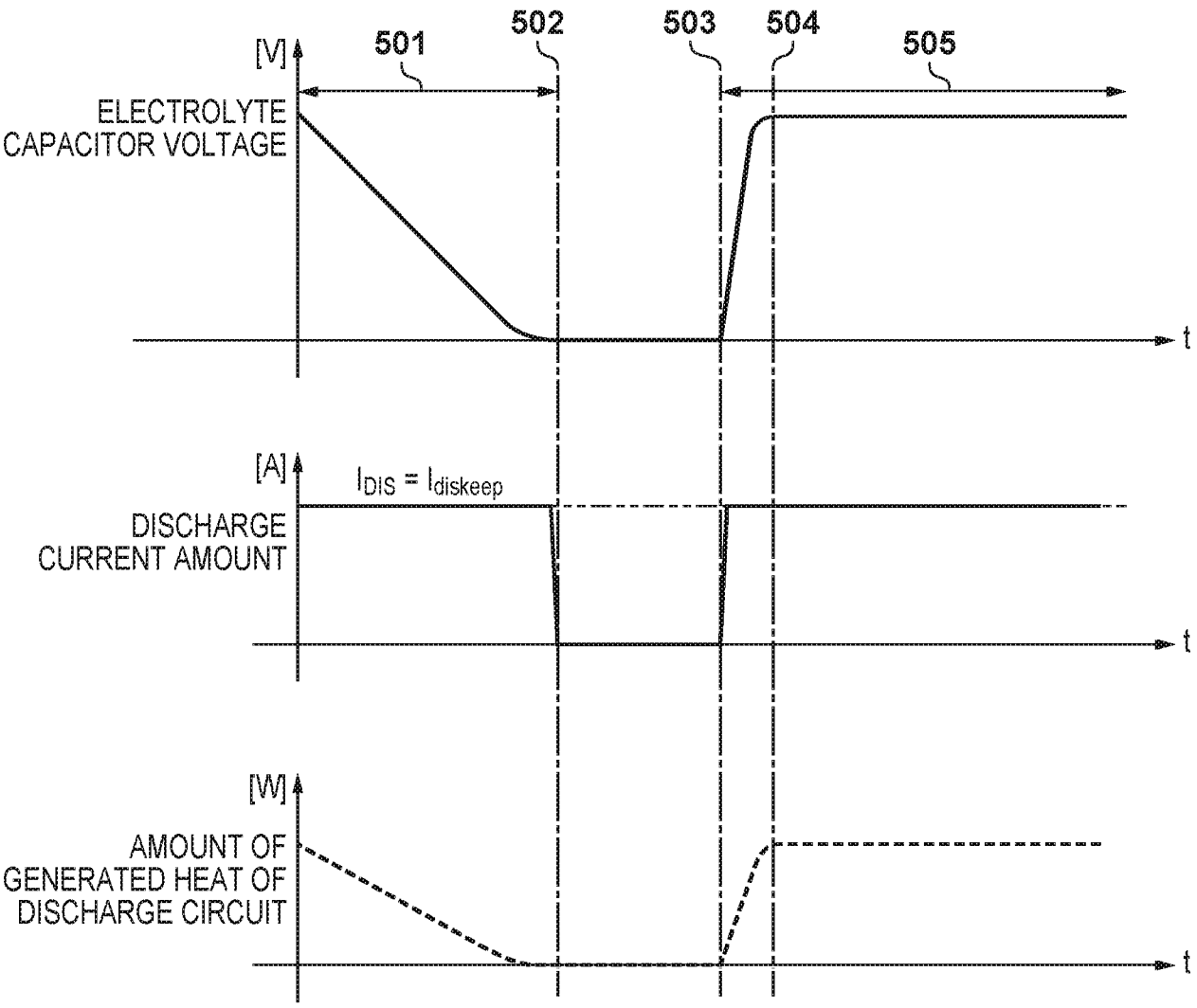
FIGS. 5A, 5B, and 5C are timing charts showing head power supply voltages when a head power supply is discharged and a short-to-supply failure occurs according to related art.

$I_{diskeep}$ as a discharge current restricting value after discharge is complete is also a feature of this embodiment. The effects of the present invention will be explained by showing the problems of related arts in FIGS. 5A to 5C and 6A to 6C. In FIG. 5A, the ordinate indicates the voltage [V] of an electrolyte capacitor, and the abscissa indicates the passage of time. In FIG. 5B, the ordinate indicates the value [A] of a discharge current, and the abscissa indicates the passage of time. In FIG. 5C, the ordinate indicates the amount [W] of generated heat of a discharge circuit, and the abscissa indicates the passage of time. The passages of time in FIGS. 5A to 5C correspond to each other.

FIG. 5A shows a voltage when an electrolyte capacitor as a head power supply is discharged and shorts to a $V_M$ power supply after that. In a discharge period 501 of the electrolyte capacitor, as shown in FIG. 5B, $I_{DIS}$ is constant, and its value is $I_{diskeep}$. The amount of generated heat of a discharge circuit is obtained by the product of the voltage of the electrolyte capacitor and a discharge current. As shown in FIG. 5C, therefore, the amount of generated heat decreases like the voltage of the electrolyte capacitor, and both the voltage value of the electrolyte capacitor and the amount of generated heat of the discharge circuit are "0" at a timing 502 of discharge completion.

After that, when the head power supply circuit shorts to supply at a timing 503, the voltage value of the electrolyte capacitor rises as shown in FIG. 5A if the value of a leakage current from the shorted power supply is larger than the value of the discharge current. The amount of generated heat of the discharge circuit at that time is obtained by the product of the voltage of the electrolyte capacitor and the discharge current, and rises as shown in FIG. 5C. As a short-to-supply period 505 prolongs, the amount of generated heat of the discharge circuit is integrated, and destruction sometimes occurs if the generated heat amount exceeds the allowable loss of a component.

Figures 6A, 6B, 6C:
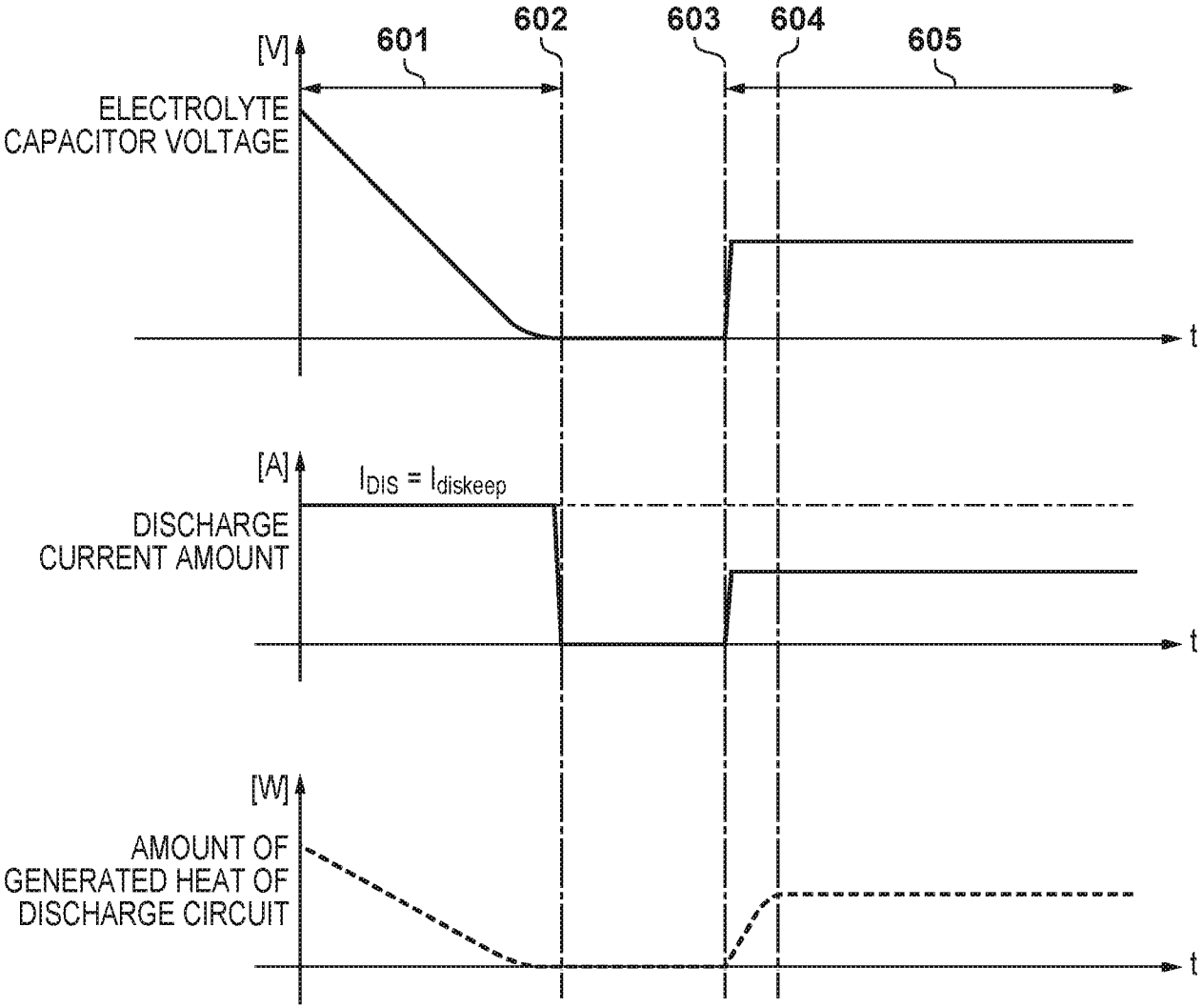
FIGS. 6A, 6B, and 6C are timing charts showing head power supply voltages when a head power supply is discharged and a short-to-supply failure occurs according to related art.

The axes of FIGS. 6A to 6C are respectively the same as those of FIGS. 5A to 5C. If the value of the leakage current from the shorted power supply is smaller than the value of the discharge current, as shown in FIGS. 6A to 6C, the voltage of the electrolyte capacitor does not increase to $V_M$, the discharge current value is smaller than the restricting current value, and the generation of heat of the discharge circuit decreases. If the discharge circuit keeps operating, however, integration of the amount of generated heat can similarly occur, and this may lead to destruction of a circuit element.

Figures 7A, 7B, 7C:
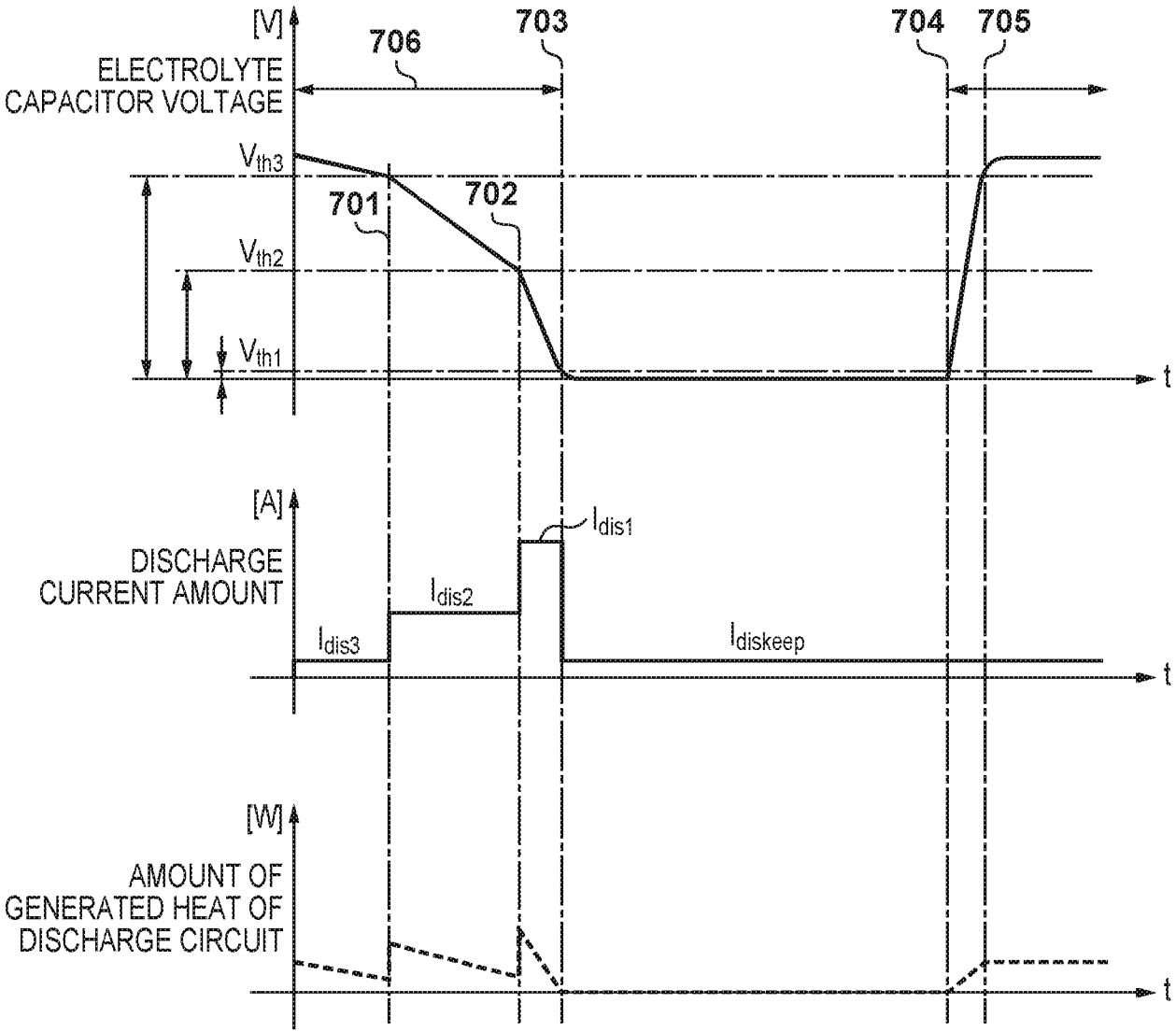
FIGS. 7A, 7B, and 7C are timing charts showing head power supply voltages when the head power supply is discharged and a short-to-supply failure occurs according to the embodiment.

Next, the operation of this embodiment will be explained with reference to FIGS. 7A to 7C. The axes of FIGS. 7A to 7C are respectively the same as those of FIGS. 5A to 5C. Note that FIGS. 7A to 7C respectively correspond to FIGS. 3A to 3C after the timing 306, but the direction of the ordinate is changed in FIG. 7B for ease of explanation. In this embodiment, in a discharge period 706 in FIG. 7A, the discharge current is restricted to $I_{dis3}$ until a timing 701 at which the voltage of the electrolyte capacitor 105 of the head power supply becomes lower than $V_{th3}$. Therefore, the generation of heat of the discharge circuit can be suppressed although the discharge time prolongs. Then, in the discharge period 706, the discharge current is restricted to $I_{dis2}$ from the timing 701 to a timing 702 at which the voltage of the electrolyte capacitor becomes lower than $V_{th2}$. $I_{dis2}$ is larger than $I_{dis3}$, but the amount of generated heat of the discharge circuit can be suppressed because the voltage of the electrolyte capacitor 105 is low. It is also possible to shorten the discharge time by thus switching the discharge currents.

Subsequently, the discharge current is restricted to $I_{dis1}$ from the timing 702 to a timing 703 at which the voltage of the electrolyte capacitor becomes lower than $V_{th1}$. Although the restricting current increases in this case as well, the generation of heat of the discharge circuit can be suppressed because the voltage of the electrolyte capacitor 105 decreases. It is also possible to further shorten the discharge time by thus switching the discharge currents. In addition, when the voltage of the electrolyte capacitor 105 becomes lower than $V_{th1}$, the value of the discharge current is restricted to $I_{diskeep}$. By setting the current value $I_{diskeep}$ at a value which suppresses the amount of generated heat so as not to destroy the discharge circuit 107 even when the voltage of the electrolyte capacitor 105 becomes $V_M$, it is possible to prevent destruction of the discharge circuit when short to supply occurs. Note that in this embodiment, $V_M$ is the maximum voltage in the apparatus, and $V_M$ when the electrolyte capacitor 105 shorts to supply is recognized before the process shown in FIGS. 2A and 2B is started. This makes it possible to set the current value $I_{diskeep}$ which can prevent destruction of the discharge circuit 107 even when the voltage becomes $V_M$.

This embodiment has been explained by taking a printing apparatus including a printhead as an example. However, a control apparatus having no printhead may also execute the process of this embodiment. In addition, the power supply destination may also be an operation unit different from the printhead.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107854, filed May 27, 2015, which is hereby incorporated by reference herein in its entirety.

What is claimed is:

1. A control apparatus including a power supply unit configured to supply electric power, comprising:

a capacitor connected to a power supply line extending from the power supply unit to a printhead;

a discharge circuit configured to release charge stored in the capacitor; and a control unit configured to control a current value during a discharge operation by the discharge circuit, such that the current value increases as a voltage value of the capacitor decreases, and wherein the control unit controls the current value during the discharge operation by the discharge circuit, such that an amount of generated heat of the discharge circuit, which is obtained based on a difference between the voltage value of the capacitor and GND, and the current value during the discharge operation by the discharge circuit, does not exceed an allowable loss of the discharge circuit.

2. The apparatus according to claim 1, wherein if the voltage value of the capacitor decreases from a first voltage value to a second voltage value, the control unit increases a value of a current flowing through the discharge circuit from a first current value to a second current value, such that an amount of generated heat of the discharge circuit does not exceed an allowable loss of the discharge circuit, and if the voltage value of the capacitor does not decrease from the first voltage value to the second voltage value, the control unit maintains the first current value.

3. The apparatus according to claim 1, wherein after the discharge operation is complete, the control unit performs switching such that the value of the current flowing through the discharge circuit is restricted to a value smaller than that during the discharge operation.

4. The apparatus according to claim 1, wherein after the discharge operation is complete, the control unit maintains an operation of the discharge circuit by switching such that a high-impedance state is obtained.

5. The apparatus according to claim 1, wherein the control unit reduces the current value during the discharge operation by the discharge circuit, such that an amount of generated heat of the discharge circuit, which is obtained from a product of a difference between the voltage value of the capacitor and GND, and the current value during the discharge operation by the discharge circuit, does not exceed an allowable loss of the discharge circuit.

6. The apparatus according to claim 1, further comprising the printhead.

7. A control method of a control apparatus which comprises:

a power supply unit configured to supply electric power;

a capacitor connected to a power supply line extending from the power supply unit to a printhead; and a discharge circuit configured to release charge stored in the capacitor, wherein the control method comprises:

controlling a current value during a discharge operation by the discharge circuit, such that the current value increases as a voltage value of the capacitor decreases, and wherein the current value is controlled during the discharge operation by the discharge circuit, such that an amount of generated heat of the discharge circuit, which is obtained based on a difference between the voltage value of the capacitor and GND, and the current value during the discharge operation by the discharge circuit, does not exceed an allowable loss of the discharge circuit.

8. The method according to claim 7, wherein if the voltage value of the capacitor decreases from a first voltage value to a second voltage value, a value of a current flowing through the discharge circuit is increased from a first current value to a second current value, such that an amount of generated heat of the discharge circuit does not exceed an allowable loss of the discharge circuit, and if the voltage value of the capacitor does not decrease from the first voltage value to the second voltage value, the first current value is maintained.

9. The method according to claim 7, wherein the control method further comprises: after the discharge operation is complete, performing switching such that the value of the current flowing through the discharge circuit is restricted to a value smaller than that during the discharge operation.

10. The method according to claim 7, wherein the control method further comprises: after the discharge operation is complete, maintaining an operation of the discharge circuit by switching such that a high-impedance state is obtained.

11. The method according to claim 7, wherein the current value is reduced during the discharge operation by the discharge circuit, such that an amount of generated heat of the discharge circuit, which is obtained from a product of a difference between the voltage value of the capacitor and GND, and the current value during the discharge operation by the discharge circuit, does not exceed an allowable loss of the discharge circuit.

12. The method according to claim 7, wherein the control apparatus further comprises the printhead.

* * * * *